US005430359A

United States Patent [19]

Swenson et al.

[11] Patent Number: 5,430,359

[45] Date of Patent: Jul. 4, 1995

[54] SEGMENTED VANE RADIO-FREQUENCY QUADRUPOLE LINEAR ACCELERATOR

[75] Inventors: Donald A. Swenson, Waxahachie, Tex.; Wayne D. Cornelius, San Diego; Phillip E. Young, Temecula, both of Calif.

[73] Assignee: Science Applications International Corporation, San Diego, Calif.

[21] Appl. No.: 969,914

[22] Filed: Nov. 2, 1992

[51] Int. Cl.[6] ..... H01J 25/10

[52] U.S. Cl. ..... 315/501; 315/500; 315/505

[58] Field of Search ..... 328/227, 228, 233; 313/359.1, 361.1, 360.1; 315/5.41, 5.42, 500, 501, 505

[56] References Cited

U.S. PATENT DOCUMENTS 4,490,648 12/1984 Lancaster et al. ..... 328/233 X
4,801,847 1/1989 Sakudo et al. ..... 315/5.42 X

OTHER PUBLICATIONS

Delayen et al., "Design and Modeling of Superconducting RFQ Structures," *Proceedings of the 1992 Linear Accelerator Conference*, Aug. 24–28, 1992, Ottawa, Ontario, Canada, pp. 692–694 (Published Nov. 1992).

Shephard et al., "Design for a Superconducting Niobium RFQ Structure," *Proceedings of the 1992 Linear Accelerator Conference*, Aug. 24–28, 1992, Ottawa, Ontario, Canada, pp. 441–443 (Published Nov. 1992).

*Primary Examiner*—Donald J. Yusko
*Assistant Examiner*—N. D. Patel
*Attorney, Agent, or Firm*—Fitch, Even, Tabin & Flannery

[57] ABSTRACT

A radio frequency quadrupole (RFQ), which is a combination of the standard 4-vane and 4-rod designs, with a window or windows cut through mid-portions of the normally solid vanes. The windows decrease the resonant frequency, minimize undesirable mode coupling in the RFQ and result in a smaller and more easily tuned accelerator.

4 Claims, 9 Drawing Sheets

SEGMENTED VANE RADIO-FREQUENCY QUADRUPOLE LINEAR ACCELERATOR

FIELD OF THE INVENTION

The present invention relates generally to linear particle accelerators, and more specifically to radio-frequency quadrupole (RFQ) linear accelerators for the acceleration of atomic and molecular ions.

BACKGROUND OF THE INVENTION

Traditional charged particle accelerators, such as cyclotrons, which depend upon magnetic fields for acceleration and focusing of the charged particle beam are massive and expensive, limiting their application to research laboratories. Further, the available beam from such a magnetically controlled device can not be focussed narrowly enough for many applications.

In the 1970's, two Russian scientists introduced a dramatically new concept for accelerating charged particles. Instead of relying on magnetic fields, charged particles were accelerated in a linear accelerator (linac) by subjecting them to high frequency alternating electric fields, established using four poles (a quadrupole). This device is known as a radio-frequency quadrupole (RFQ) accelerator or RFQ linac. As developed and improved over the years, RFQ accelerators have been used to accelerate ions and other charged particles from energies of a few tens of kilo electron volts (keV) per atomic mass unit (AMU) up to energies of a few million electron volts (MeV) per AMU. Compared to previous accelerators, RFQ accelerators provide for relatively simple construction and operation, compactness, lightweight, and portability. RFQ accelerators will accept large quantities of ions with low kinetic energies and accelerate them to much higher energies.

Modern RFQ linear accelerators typically consist of a radio-frequency resonator with four-pole symmetry about a centerline axis and are divided into two basic classes: a 4-vane geometry and a 4-rod geometry.

The 4-vane RFQ consists of a cylindrical, square, or rectangular box divided longitudinally into four quadrants by partitions called vanes. The vanes originate at an inner wall of the box and protrude toward the centerline axis. Each quadrant of the RFQ is a separate rf resonator and the combination of the four is used to provide an rf electric quadrupole field within a cylindrical region near the axis of the structure which forms the ion beam channel. The rf field both focuses and accelerates the ion beam. In particular, in a 4-vane RFQ linac, current at radio frequencies is applied to current loops that transversely protrude into each quadrant of the linac. The currents create alternating magnetic fields within the linac, with the flux lines substantially parallel to the longitudinal axis of the vanes. A space between the base of each vane and an inner wall of the housing where the vane is fastened to the wall allows for the coupling of the magnetic fields between adjacent quadrants. The alternating magnetic fields, in turn, induce quadrant currents that alternately charge and discharge the tips of the vanes. The alternating charge on the vane tips provides means for accelerating a charged particle along the ion beam channel.

Since the 4-vane RFQ is an rf cavity resonator, the wavelength of the desired resonant frequency determines the physical dimensions of the device. This constrains the size and resonant frequencies for which the 4-vane RFQ can be designed. Because the physical dimensions of the 4-vane RFQ determines its rf resonant frequency, 4-vane RFQ's can have only a single, fixed resonant frequency. This limits its flexibility. Further, in order to obtain a proper "tuning" of a 4-vane RFQ linac, that is to say an alignment of the vanes and other parts so as to achieve the desired rf resonant frequency and mode and a high quality beam of charged particles, the transverse position of the vanes must be accurate to within about 7 parts per million. This accuracy is relatively easy to achieve at low resonant frequencies. However, at higher frequencies, and therefore smaller wavelengths and smaller RFQ dimensions, manufacturing and measurement tolerances limit the practical upper frequency attainable. The practical upper frequency of a 4-vane RFQ is about 500 MHz. Higher frequency RFQ's are presently beyond the state-of-the art of fabrication and mechanical alignment techniques.

The 4-rod RFQ consists of four rods or bars supported by transverse structures that form an inductance of a resonant circuit. A corresponding resonant capacitance comes from rod-to-rod electric fields. In general, the 4-rod RFQ is less efficient than the 4-vane RFQ. However, because the inductance and capacitance functions are separated by the resonator structure, the physical dimensions of the 4-rod RFQ need not be related to the wavelength of the resonant frequency. Thus, the physical dimensions are not determined by the wavelength of the resonant frequency as in the 4-vane RFQ and RFQ's with operating frequencies higher than 500 MHz can be fabricated as 4-rod devices. In practice, however, the longitudinal separation of the inductive rod supports cannot exceed about 14% of a wavelength without inducing unacceptable longitudinal field irregularities. Hence, the number of rod supports must increase with frequency (as the wavelength decreases), which means that the inductance of each support must be decreased in order to keep the inductance of the combination constant and thereby maintain the proper resonant frequency. The physical dimensions of the inductor supports must therefore decrease with increasing frequency. This size reduction leads to increased rf power loss and increased transverse field instability due to parasitic electromagnetic fields. Hence, low frequency RFQ's (below 150 MHz) tend to be 4-rod devices while high frequency RFQ's (above 300 MHz) tend to be 4-vane devices.

In any RFQ, the three lowest order resonant modes (the zero-order modes) consist of one quadrupole and two dipole modes. In a 4-vane RFQ, the zero-order dipole modes are lower in frequency than the zero-order quadrupole mode. In a 4-rod RFQ, the quadrupole mode is lowest in frequency. The desired operating mode for efficiently focusing and accelerating charged particles along the length of the RFQ is the zero-order quadrupole mode that has a uniform rf field intensity along the length of its structure. In practice, however, the rf fields within an RFQ are a mixture of the fields due to various quadrupole and dipole modes. Thus, within current RFQ's, the dipole component should be less than 5% of the quadrupole component and the rf fields should be constant to within 10% in the longitudinal direction. For high-quality charged particle beams, the dipole component should be less than 2% of the quadrupole component and the rf fields should be constant to within 2% in the longitudinal direction. Delicate tuning is necessary to achieve this result.

Further, in current RFQ's, coupling of dipole and quadrupole modes within an RFQ is primarily responsible for both longitudinal and transverse field errors. The potential for coupling between the desired quadrupole and undesired dipole modes is proportional to the frequency separation of these modes. The greater the separation, the less the potential for coupling and the greater the potential for higher quality tunable beams. Coupling between longitudinal dipole and quadrupole modes can be a particularly severe problem in "long" RFQ's since the frequency separation between longitudinal modes is inversely proportional to the length of the RFQ. The longer the RFQ, the greater the probability of coupling by higher-order dipole modes even at the frequency of the lowest-order quadrupole mode.

A need therefore exists for an RFQ design which improves efficiency, increases the resonant frequency range, and facilitates tuning all the while preserving the ruggedness, compactness, focusing, and simplicity features of prior RFQ designs. The present invention satisfies these needs.

SUMMARY OF THE INVENTION

The present invention comprises a segmented-vane radio-frequency quadrupole (SVRFQ) charged-particle accelerator that accelerates ions up to energies as high as 2 or 3 MeV/AMU. The SVRFQ represents a combination of the 4-vane and 4-rod RFQ configurations. It is similar to the 4-vane RFQ, but is modified by cutting apertures, or "windows", through the normally solid vanes to couple magnetic fields in the four quadrants at locations other than at the ends connected to the vane housing. The number, width, and location of the windows is dependent on the specific characteristics desired. The windows can be either symmetric (each vane having identical windows at identical locations), antisymmetric (each vane having windows at locations where an adjacent vane is solid), or asymmetric (one vane having windows in locations where the others are solid).

The effect of the windows is to increase the inductance of the rf current paths in the RFQ and hence to lower the resonant frequency of the device. Further, the windows divide the 4-vane RFQ into shorter segments, each of which acts more like a 4-rod device. The number and location of the windows depends on the desired shift in the resonant frequency of the RFQ and the efficiency of the resulting rf operation.

The SVRFQ embodies some of the best features of the 4-vane and 4-rod designs. Cutting windows through the vanes increases the frequency separation between the low frequency quadrupole and dipole modes and inverts the order of the lowest frequency modes in favor of the desired zero-order quadrupole mode having a uniform rf field intensity. This allows the SVRFQ to be significantly smaller and more easily tuned than a conventional RFQ and effectively eliminates problems of dipole and quadrupole mode competition with its resultant longitudinal field errors.

BRIEF DESCRIPTION OF THE DRAWINGS

In FIG. 9, the windows in the vanes are arranged in a symmetric pattern, in FIG. 10 in a antisymmetric pattern and in FIG. 11 in a asymmetric pattern.

DETAILED DESCRIPTION OF THE INVENTION

Figure 1A:
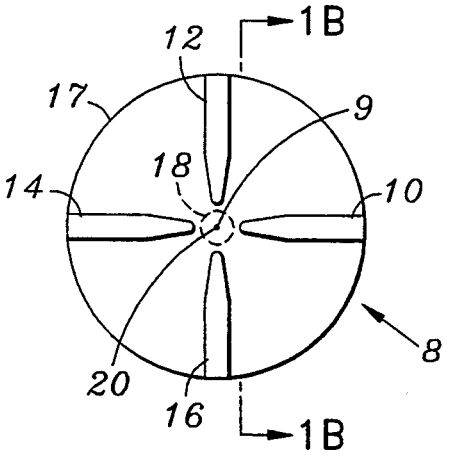
FIGS. 1A and 1B are end and side views of the vanes of a 4-vane RFQ.

The structure and operation of the SVRFQ of the present invention can be best understood if the structure and operation of a conventional 4-vane RFQ linac is first understood. The following is intended as an overview and not a thorough theoretical treatment of a 4-vane RFQ.

A 4-vane RFQ accelerator uses a quadrupole electric field to both focus and accelerate charged particles. The quadrupole electric field is generated by applying an rf current to four spaced-apart electrodes or vanes. The orientation of the four vanes is as shown in the end view of FIG. 1A. As illustrated, a 4-vane RFQ linac 8 comprises four axially elongated vanes 10, 12, 14, and 16 supported within a vane housing 17 having a cylindrical or rectangular cross-section. The vanes are circumferentially equally spaced 90 degrees apart and extend inwardly from an inner wall of the vane housing 17. Thus arranged, the four vanes define (i) first and second pairs of opposing vanes transversely dividing the cavity into four equal axially extending sections or quadrants, (ii) a radio frequency resonator cavity elongated along a centerline 9 of the RFQ and (iii) an ion beam channel 18 for an ion beam 24 having an axis 20 following the centerline 9 between opposing tips of the vanes.

Figure 1B:
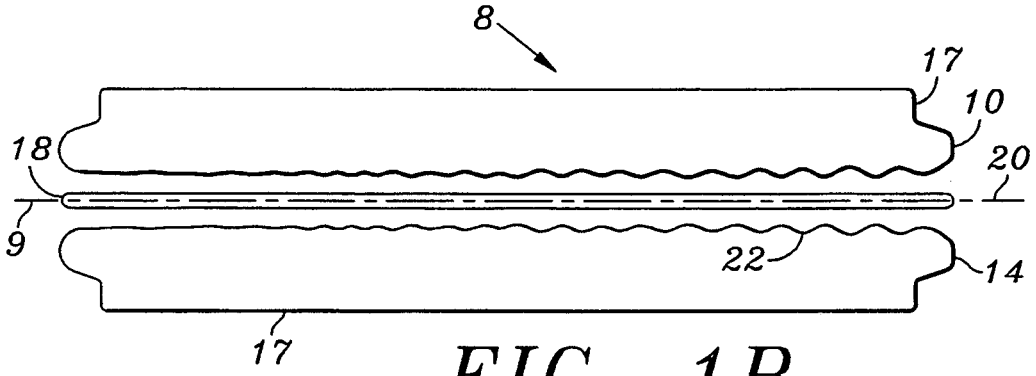
Figure 4A:
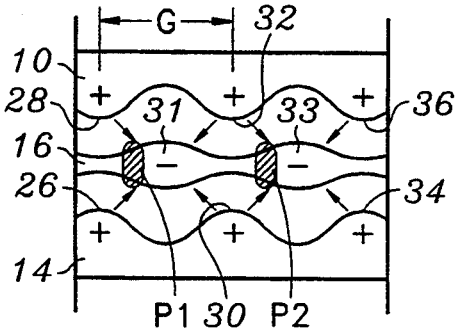
FIGS. 4A, 4B and 4C diagram the acceleration process in the RFQ of FIGS. 1A and 1B.

As illustrated in FIG. 1B, 4A, B and C, the innermost tip edges of vanes 10, 12, 14, and 16 are scalloped with increasingly deeper and longer curved, longitudinally extending serrations 22 (shown in FIG. 1B). The serrations of the opposing vanes coincide while the serrations of adjacent vanes are offset. That is, peaks of the serrations 22 of the pair of opposing vanes 10 and 14 and the peaks of the serrations 22 of the pair of opposing vanes 12 and 16 are located at the same longitudinal positions along the length of the vanes. However, the peaks of serrations 22 of the opposing vanes 10 and 14 coincide with valleys in the serrations of vanes 12 and 16, and vice versa.

In operation, the vane tips are alternatively charged to a positive and negative potential in order to "push and pull", by repulsive and attractive electrostatic forces, charged particles in the ion beam 24 through the narrow region surrounded by the vane tips and along the beam channel 18. In this process, the pair of opposing vanes 10 and 14 are both charged to one polarity while the pair of opposing vanes 12 and 16 are both charged to the opposite polarity. The frequency at which the alternating charge is applied to the vanes remains constant, but the distance between adjacent peaks of the serrations increases. Hence, a charged particle moving through the accelerator must accelerate in order to cover an increasingly longer distance (the distance between adjacent peaks of the serrations) in the same amount of time as the period of the oscillating signal.

Figure 2:
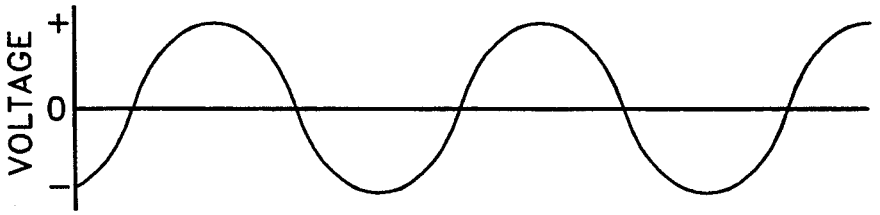
FIG. 2 diagrams an alternating voltage used to power an RFQ to provide for the acceleration of charged particles.

FIG. 2 diagrams an alternating voltage used to power an RFQ accelerator, such as the 4-vane RFQ of FIGS. 1A and 1B. The alternating voltage will be used as a reference in the description of the focusing and accelerating functions presented below in connection with FIGS. 3A–3C and FIGS. 4A–4C.

Figure 3A:
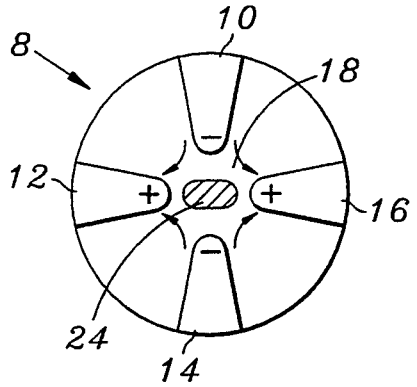
FIGS. 3A, 3B, and 3C show a charged particle packet under the influence of an electric quadrupole field between the vanes. The packet changes shape, going from FIG. 3A to FIG. 3C configurations as the charge on the tips of the vanes varies.
Figure 3B:
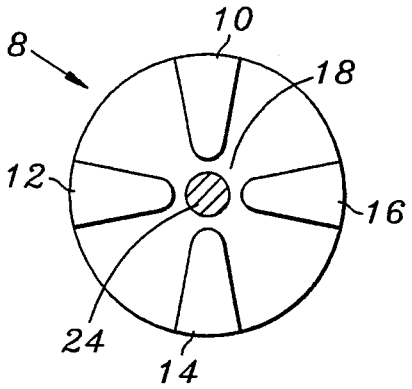
Figure 3C:
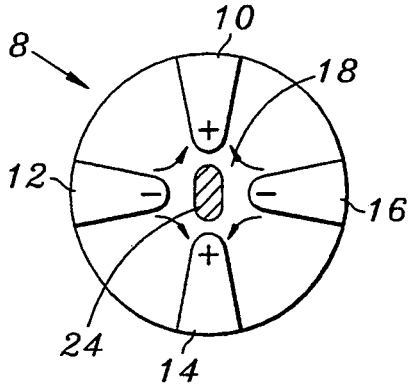

FIGS. 3A, 3B, and 3C represent end views of the RFQ of FIGS. 1A and 1B and schematically illustrate how the quadrupole field of a 4-vane RFQ achieves its focusing function. In FIG. 3A, corresponding to those periods of time when the voltage of FIG. 2 is positive, the vanes 12 and 16 are charged positively, and the vanes 10 and 14 are charged negatively. At this point in time, the positively charged particle beam 24, such as a proton beam, located in the channel 18, tends to assume an oblong cross sectional shape. The long axis of the oblong is aligned with the positively charged vanes 12 and 16, and the short axis of the oblong is aligned with the negatively charged vanes 10 and 14. At this point in time, electric forces act in directions tending to restore the beam to a circular shape.

FIG. 3B depicts those periods of time when the voltage in FIG. 2 is zero. None of the vanes is charged, and the charged particle beam 24 assumes a generally circular cross-sectional shape.

FIG. 3C depicts those periods of time when the voltage in FIG. 2 is negative. Vanes 10 and 14 are then charged positively, while vanes 12 and 16 are charged negatively. The charged particle beam 24 assumes an oblong cross sectional shape, with the long axis of the oblong aligned with the positively charged vanes 10 and 14 and the short axis of the oblong aligned with the negatively charged vanes 12 and 16. At this point in time, electric forces act in directions tending to restore the beam to a circular shape.

In this manner, the charged particles of the beam 24 are confined within the channel 18 between the vanes. While the overall cross-sectional shape of the beam oscillates between an oblong of one orientation to an oblong rotated 90 degrees, the channel 18 between the vanes is very small and the beam 24 is focused to an even smaller size.

Figure 4B:
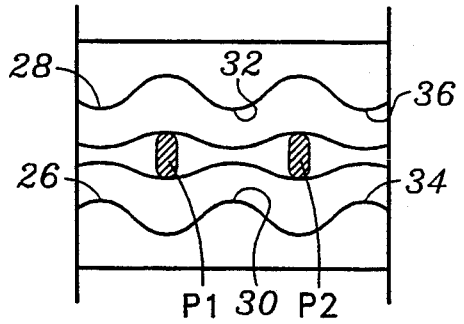
Figure 4C:
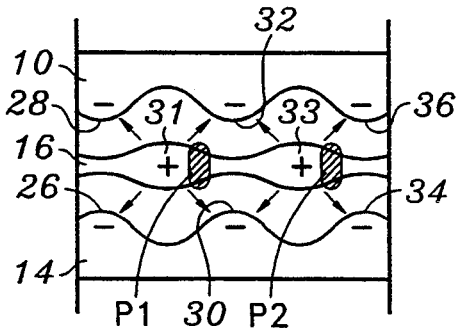

FIGS. 4A, 4B, and 4C schematically illustrate how the quadrupole field of a 4-vane RFQ accelerator achieves its accelerating features. These figures show a small portion of a side view of a 4-vane RFQ accelerator. Only three of the vanes are visible in the figures, vanes 10 and 14 (lying in the plane of the paper) and vane 16 (lying in a plane perpendicular to the paper. Vane 12 has been removed for clarity. As described above, the edges of the vanes which face the centerline of the RFQ are scalloped. The peaks of the perpendicular vanes are offset. Hence, a first peak 26 of the vane 14 is opposite a similar peak 28 of the vane 10 in the same plane. Second and third peaks 30 and 34 of the vane 14 are likewise opposite similar peaks 32 and 36 of the vane 10. But peaks 31 and 33 of the vane 16 are offset midway between peaks 26 and 30, and peaks 30 and 34 respectively of vane 14.

The region between adjacent peaks of one set of vanes, e.g., the region G between vane peaks 26 and 30, may be considered as an acceleration cell through which a charged particle is accelerated. Acceleration occurs as shown in the sequence of FIGS. 4A through 4C. In FIG. 4A, corresponding to those periods of time when the voltage in FIG. 2 is positive, the peaks 26 and 30 of the vane 14 and the corresponding peaks 28 and 32 of the vane 10 are positively charged. Hence, a packet P1 of positively charged particles in the beam 24 moving left to right in the figure is repelled away from the positively charged peaks 26 and 28 in vanes 14, and 10 and attracted towards the negatively charged peaks 31 in vane 16 and a corresponding negative peak in vane 12 (not shown). A similar process occurs relative to a second packet P2 of positively charged particles. As the packet P1 approaches the negatively charged peak 31, the charge thereon goes to zero, corresponding to those periods of time when the current in FIG. 2 is zero, as shown in FIG. 4B. Thus, the momentum of the particle or packet P1 continues to move it left-to-right through the acceleration cell or gap G. As it continues to move, the charge on peaks 31 and 33 becomes positive, and the charge on peaks 30 and 32 becomes negative as depicted in FIG. 4C. Hence, the charged particle packet P1 is repelled away from peak 31 and towards peaks 30 and 32. In this manner, the changing quadrupole electric field propels the charged particle packets P1 and P2 through each acceleration cell or gap.

The time required for the charged particle packets P1 and P2 to traverse an acceleration cell G is the time it takes the voltage applied to the vanes to reverse its polarity, one half period of the voltage waveform shown in FIG. 2. Two acceleration cells or gaps will be traversed by a charged particle in one period of the charging voltage waveform. This distance is known as the particle wavelength. By maintaining the voltage waveform used to charge vanes at a fixed frequency, and by gradually increasing the length of the acceleration cells or gaps, as shown in FIG. 1B, the particle wavelength is increased and the charged particles or packets traverse an increasingly longer distance in fixed time increments as the packets move from left-to-right through the RFQ. In this manner, the charged particle beam is accelerated through the RFQ.

Figure 5:
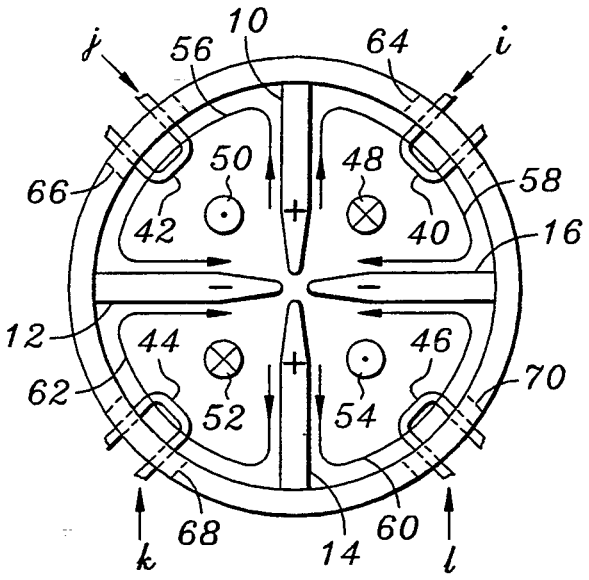
FIG. 5 is an end view of a 4-vane RFQ showing the magnetic fields therein.

FIG. 5 illustrates the manner in which respective alternating electrical currents i, j, k, and l flowing in respective current loops 40, 42, 44 and 46 in each quadrant of the RFQ linac, generate a magnetic field for powering the linac. A magnetic field is generated around a current-carrying conductor in accordance with well known electromagnetic principles. The direction of the magnetic field may readily be determined by using the "right hand rule", the thumb of the right hand is pointed in the direction of the current in the conductor (the direction of positive current flow) when the fingers curl around the conductor in the direction of the magnetic field. The magnetic field generated by the currents i, j, k, and l is perpendicular to the plane of FIG. 5 except near the ends of the vanes. At the ends of the vanes, the magnetic flux lines associated with the magnetic field wrap around the vanes through cutouts in the ends of the vanes (not shown) at a base connection for the vanes to the housing 7.

The magnetic field is represented schematically in FIG. 5 by magnetic flux lines 48, 50, 52, and 54 in each quadrant of the RFQ linac. Where a flux line is perpendicular to the plane of the paper, it is represented by a cross, when the magnetic flux line flows into the plane of the paper; and the flux line is represented by a dot when the magnetic flux line flows out of the plane of the paper.

The total magnetic flux in any given quadrant of the RFQ linac results from a combination of the magnetic flux in the adjacent quadrants. That is, magnetic flux flowing into the paper in FIG. 5, e.g., the flux identified by the reference numeral 52, splits approximately equally, wrapping around the ends of the vanes 12 and 14, between the flux flowing out of the paper as indicated by the reference numerals 50 and 54. Similarly, the magnetic flux flowing into the paper identified by the reference numeral 48 also splits approximately equally between the flux flowing out of the paper as indicated by the reference numerals 50 and 54.

The magnetic fields generated by the currents i,j,k, and l change polarity at the same rates as the rf currents change polarity. Hence, the magnetic flux lines 48, 50, 52 and 54 in FIG. 5 only represent the magnetic field at one instant of time, when the currents are at their respective peak values with the polarity shown in FIG. 5. As these currents are alternating currents, alternating at a high rf frequency, the magnetic fields also alternate in polarity at this same rf frequency. The changing magnetic fields induce electrical currents flowing around the edge of each quadrant. The induced electrical currents, are schematically represented in FIG. 5 by the arrows 56, 58, 60 and 62. These induced currents combine to place an electrical charge of a desired polarity on the tip of each vane. The electrical charges, in turn, allow the RFQ linac to perform its accelerating function.

As best seen in FIG. 5, in the 4-vane RFQ linac design the current loops 40, 42, 44, and 46 protrude through respective slots 64, 66, 68, and 70 in the vane housing 17. The loops are oriented transversely relative to the longitudinal axis of the RFQ linac so that the resulting magnetic field is substantially parallel to the longitudinal axis of the RFQ linac. The vanes themselves serve as boundaries for the magnetic fields, forcing the magnetic flux lines to longitudinally (along the length of the linac) wrap around the vanes, passing through the cutouts at the ends of the vanes into the adjacent quadrants.

Figure 6:
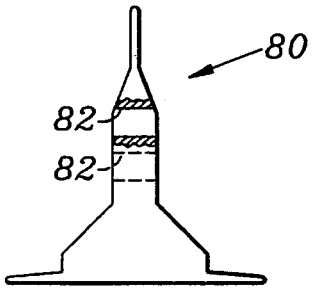
FIG. 6 is an end view, partially cut away, of one of the vanes in the SVRFQ of the present invention.

The SVRFQ linac of the present invention comprises all of the structure and is a modification of the 4-vane RFQ linac as previously described. As depicted in FIG. 6 for one of the vanes (80) included in a SVRFQ, the modification consists of cutting "windows" 82 through the normally solid vanes to produce the effects of (1) allowing the magnetic fields of the four quadrants (shown in dashed lines with arrows in FIGS. 9A, 10A and 11A to couple into adjacent quadrants of the SVRFQ at locations intermediate each end, (2) shifting the frequency of the zero-order dipole modes and quadrupole mode such that the frequency of the desired quadrupole mode is separated from and preferably less than the frequency of the dipole modes, and (3) increasing the path length of the induced surface rf currents (shown in solid lines with arrows in FIGS. 9A, 10A and 11A). A frequency shift of the quadrupole mode to below the dipole modes means that the SVRFQ is more easily tuned than its 4-vane or 4-rod counterparts, while a separation of the frequency of the quadrupole and dipole modes insures that the dipole modes will not compete with the quadrupole mode and produce longitudinal field errors as is common in prior RFQ's, The increase path length for the induced rf currents results in an increase in current path inductance which for the same capacitance lowers the resonant frequency of the SVRFQ relative to a conventional solid vane RFQ or 100% RFQ of the same physical dimensions. This allows for the construction of a SVRFQ having a given resonance frequency which is smaller in size and more compact than a 100% RFQ having a like resonance frequency.

Figure 10:
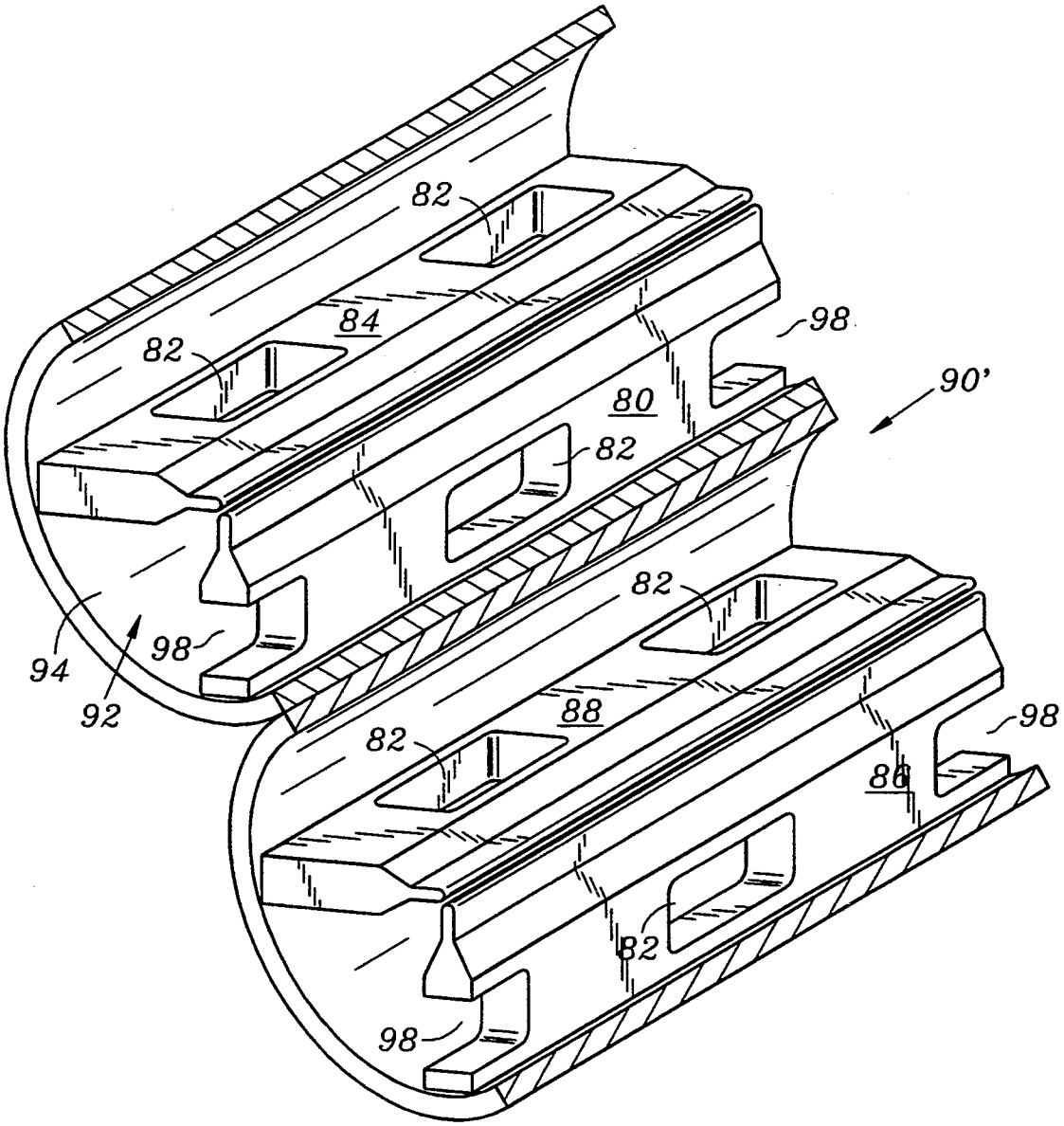
Figure 10A:
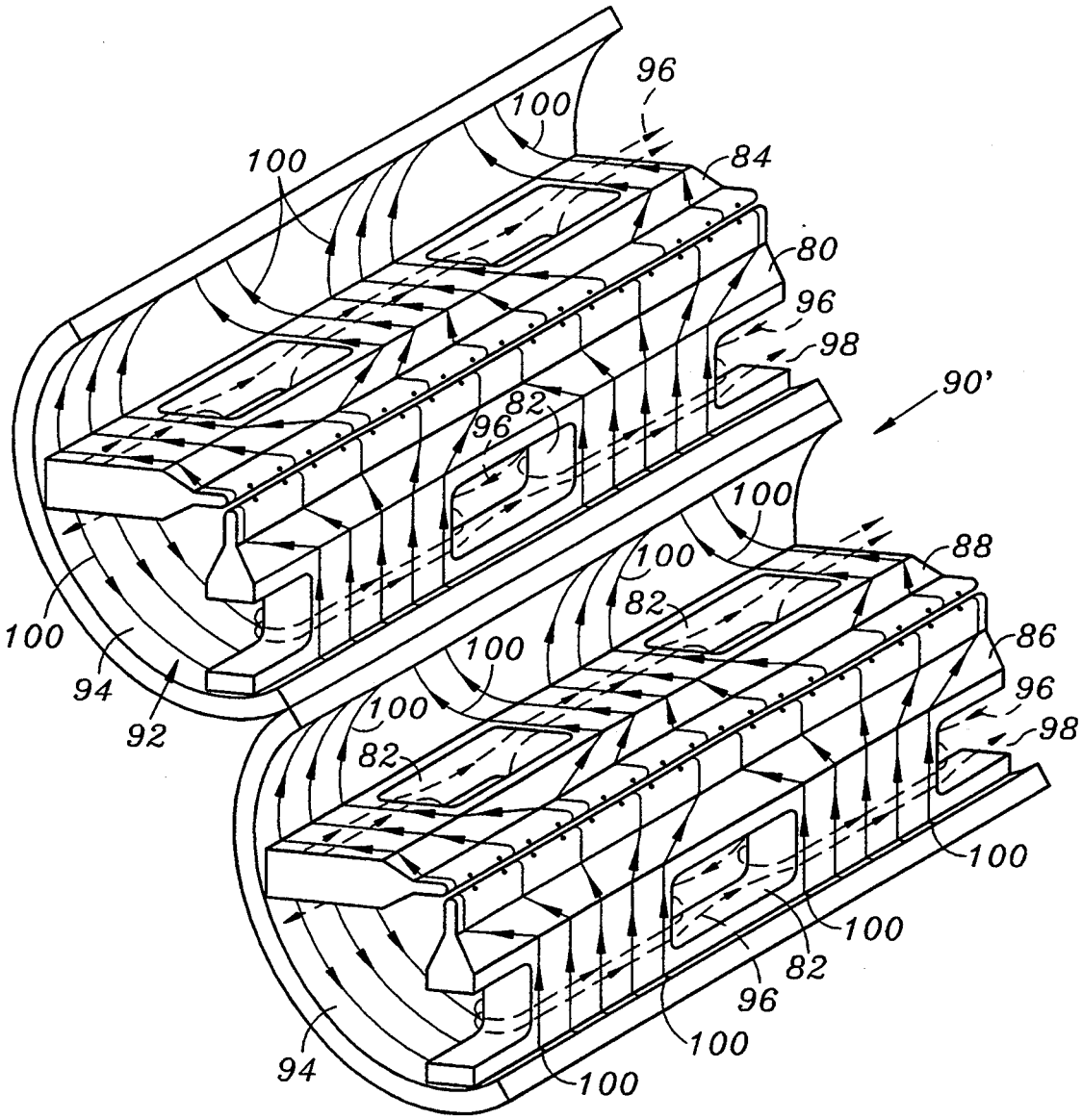
Figure 11:
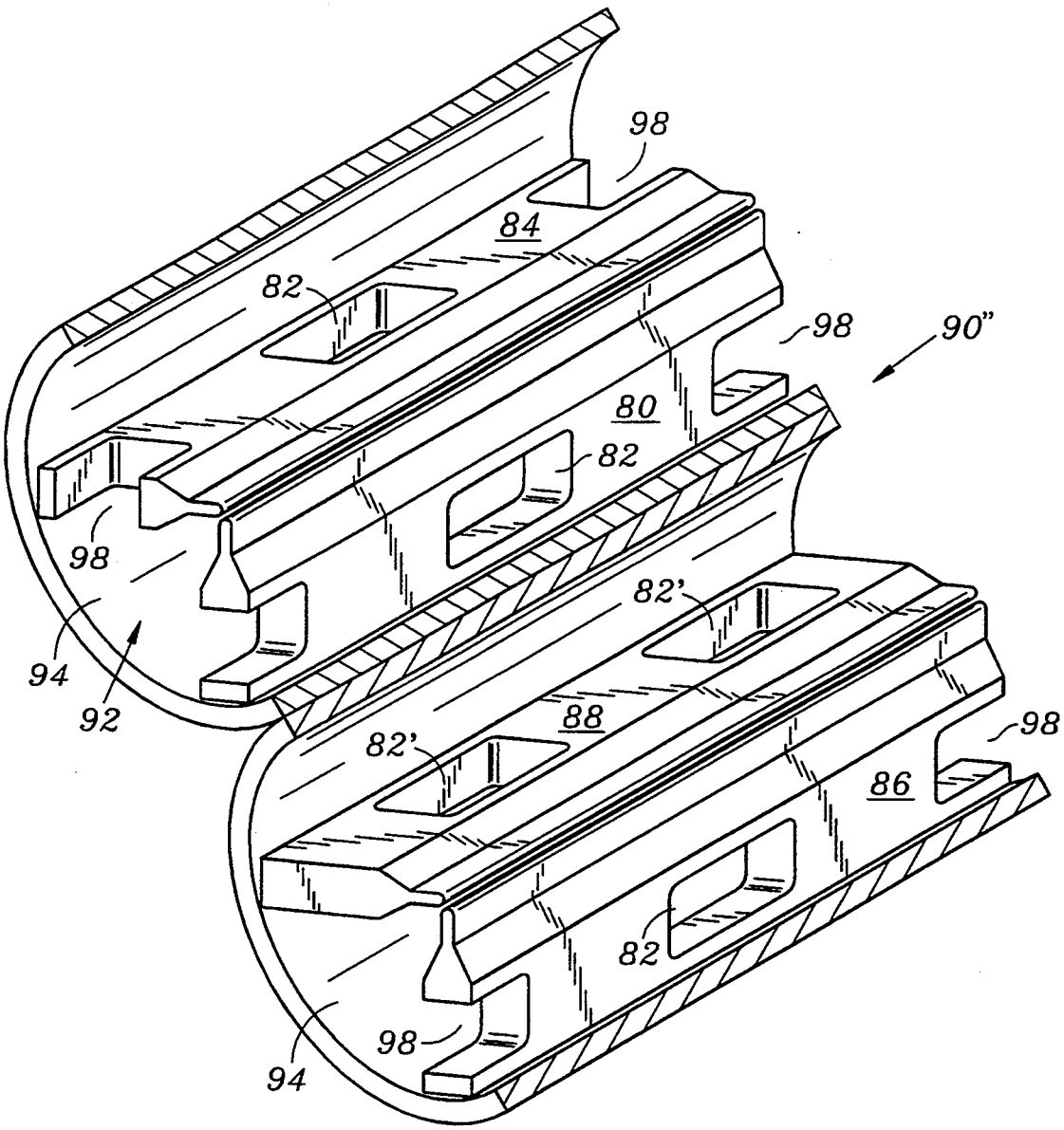
Figure 11A:
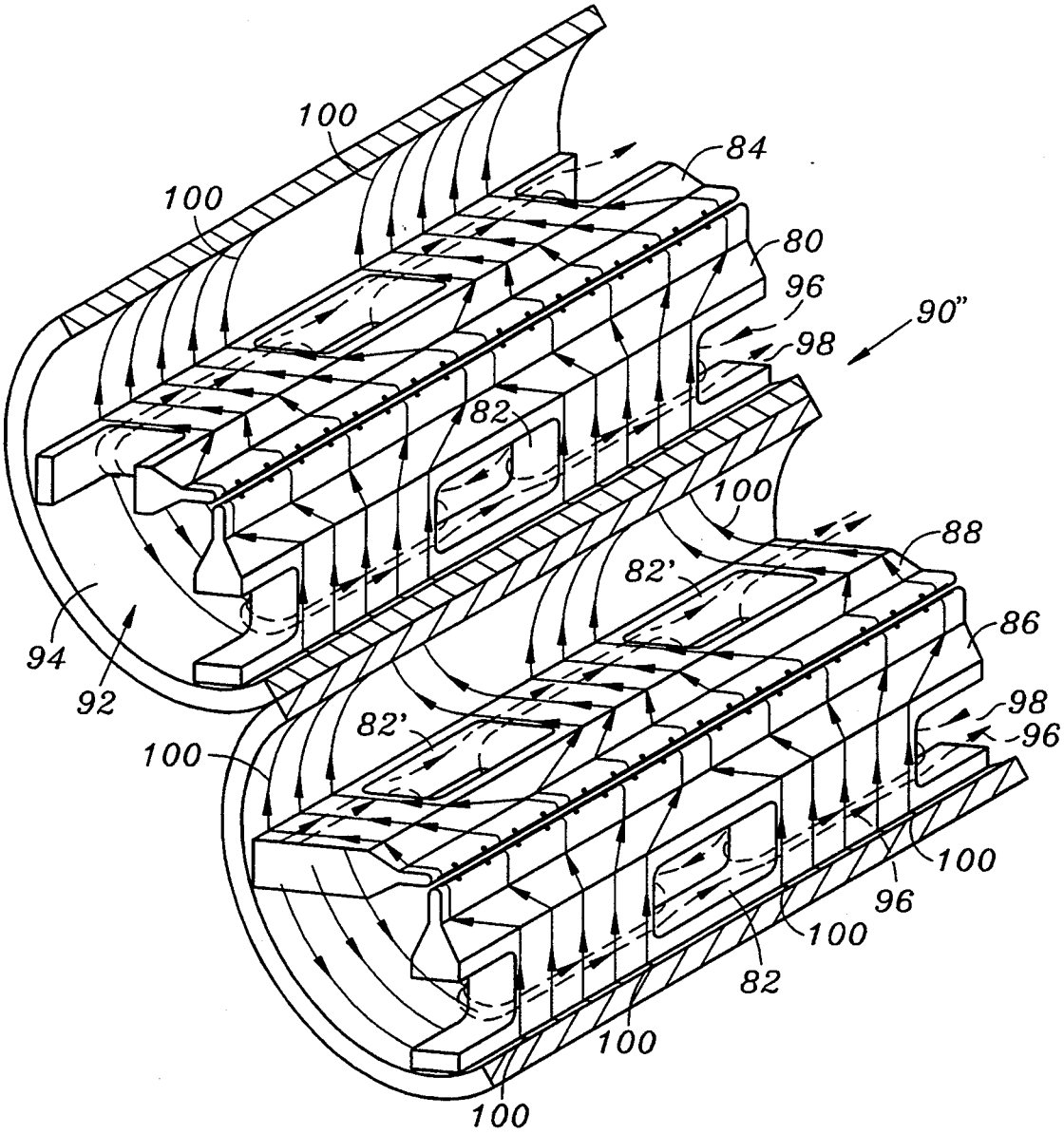

The number, size and location of the windows is dependent on the specific characteristics desired. The windows can be either symmetric (windows at identical locations on each vane) as shown in FIGS. 9 and 9A, antisymmetric (each vane having windows at locations where adjacent vanes are solid) as shown in FIGS. 10 and 10A, or asymmetric (one vane having windows in locations where the others are solid) as shown in FIGS. 11 and 11A.

More specifically, an end view of a SVRFQ will be the same as FIG. 5 with current loops 40–46, generated magnetic fields 48–54 and induced surface currents 56–62. The tips of the vanes will be serrated as previously described and charged particles will be accelerated and focused in the manner illustrated in FIGS. 1B–4C. In FIGS. 9–11A, the unwrapped interior of the SVRFQ in three different window configurations are illustrated with differences in the magnetic fields and surface currents diagrammatically depicted by dashed and solid lines with arrows. The current loops and serrated tips of the vanes of the SVRFQ are not shown for simplicity of illustration.

Figure 9:
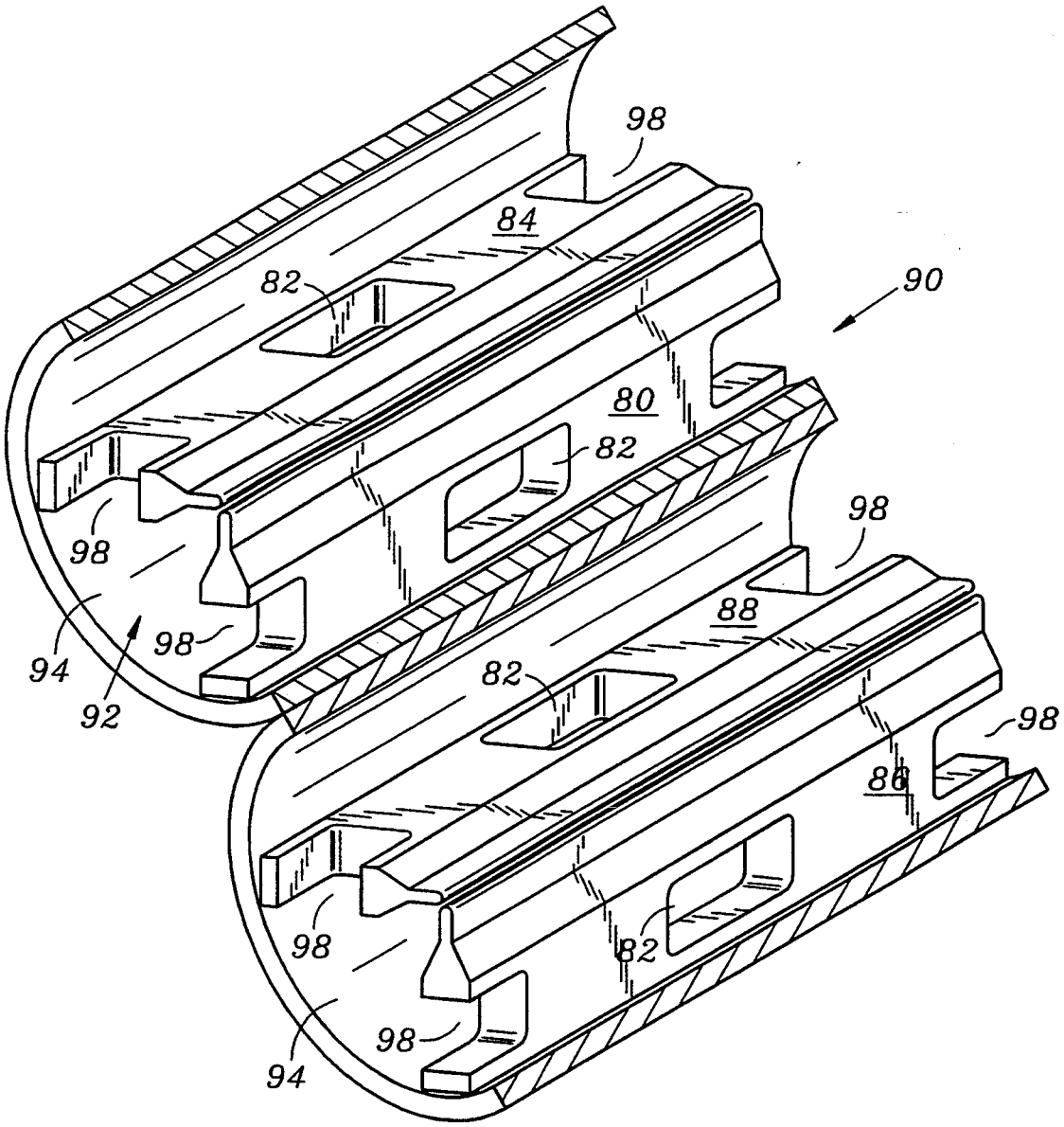
FIGS. 9, 10 and 11 are perspective views of a portion of a SVRFQ which has been split and partially unrolled to expose the window configurations within the SVRFQ.
Figure 9A:
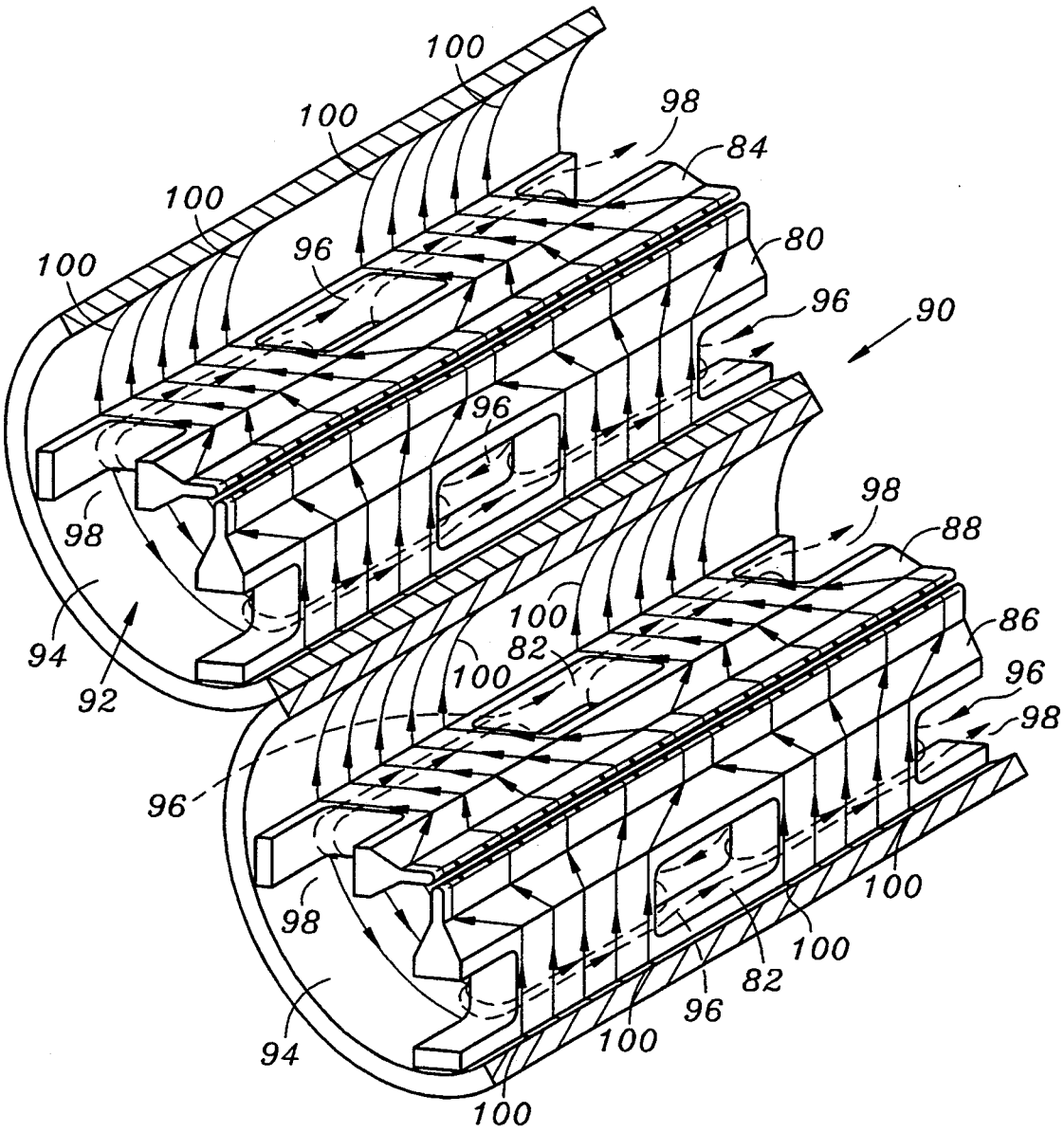
FIGS. 9A, 10A and 11A correspond to FIGS. 9, 10 and 11 respectively and show the magnetic fields, denoted by dashed lines with arrows, in regions where windows in the vanes of the SVRFQ are arranged in symmetric, antisymmetric and asymmetric patterns respectively, and shown the induced surface rf currents, denoted by the solid lines with arrows.

In FIGS. 9 and 9A, four vanes 80, 84, 86 and 88 of an SVRFQ 90 of symmetrical window configuration are illustrated, each vane having opposite front and rear radially extending ends, an elongated base and an tip opposite the base. The SVRFQ 90 comprises an elongated and cylindrical rf resonator 92 having an inner wall 94. The base of each vane is secured to and extends along the inner wall 94 such that the vanes are circumferentially evenly spaced and extend radially inward from the inner wall towards a centerline axis of the cavity to define first and second pairs of opposing vanes having tips facing each other and transversely dividing the cavity into four equal quadrants. As in the RFQ of FIG. 5, currents applied to current loops, such as 40–46 in FIG. 5 but for clarity of illustration not shown in FIGS. 9 and 9A, generate longitudinally extending alternating magnetic fields 96 along each of the four quadrants in the SVRFQ 90 to wrap through cut outs 98 in the ends of the vanes into adjacent quadrants. As previously described, such alternating magnetic fields as 96 induce alternating surface rf currents 100 which circulate circumferentially within the quadrants along the inner wall 94 of the cavity and radially extending surfaces of the vanes bounding each adjacent quadrant. In this manner, the tips of the first and second pairs of vanes cyclically assume an opposite potential whereby a quadrupole electric field is established in the region surrounding the pairs of vanes to accelerate and focus charged particles in the manner previously described for a conventional RFQ.

In the SVRFQ of FIGS. 9 and 9A, each vane includes a window 82 defined by a substantially rectangular aperture through an at a like location in each vane, for example, midway between the opposite ends thereof. The effects on the magnetic fields 96 and surface currents 100 is best illustrated in FIG. 9A. As shown, in addition to wrapping around the ends of the vanes through cut outs into adjacent quadrants, the magnetic fields 96 couple into adjacent quadrants through the windows 82. The surface currents 100 bend longitudinally in flowing between the windows 82 and thus lengthen in path length. The dipole modes are degenerate and equally shift in frequency relative to the quadrupole mode and the beneficial effects of the changes in the magnetic field coupling and lengthening of current path length are as previously described.

In FIGS. 10 and 10A, a SVRFQ 90' of antisymmetrical window configuration is illustrated. The structure is as shown and described for to FIGS. 9 and 9A except that the vanes of the first pair contain windows 82 where the vanes of the second pair are solid and visa versa. Also, (1) the surface current paths are more convoluted,
(2) the frequency shift in the dipole modes is not necessarily symmetric as in the symmetrical configuration of FIGS. 9 and 9A and
(3) the frequency of the quadrupole mode lies spaced from and in between the frequency of the dipole modes. Otherwise, the beneficial effects of the intermediate magnetic field couplings and current path lengthening are as previously described.

A similar splitting and separation of the frequencies of the dipole modes relative to the quadrupole mode is also a characteristic of the asymmetric window configuration SVRFQ 90" shown in FIGS. 11 and 11A. In the SVRFQ 90", the windows 82 in three of the vanes are identical and identically located. The window 82' in the remaining window is located where the other vanes are solid. This results in an uneven shifting the frequencies of the dipole modes relative to the quadrupole mode which is intermediate the two dipole modes. Otherwise the benefits of the intermediate magnetic coupling and increased surface current path length are as previously described.

In considering the design of the SVRFQ, a SVRFQ is best described by the percentage of solid-vane structure remaining, defined as the vane segment (VS), given in percent. The vane segment is defined as the total vane length (less the normal overhang of the vane tip at each end) minus the total of the longitudinal dimensions of the windows cut through the vane, divided by the total length of the vane (less the normal overhang), expressed as a percentage. Hence a conventional 4-vane RFQ corresponds to 100% VS while a 4-rod RFQ would correspond to a relatively low value of VS (typically less than 20% ).

Figure 7:
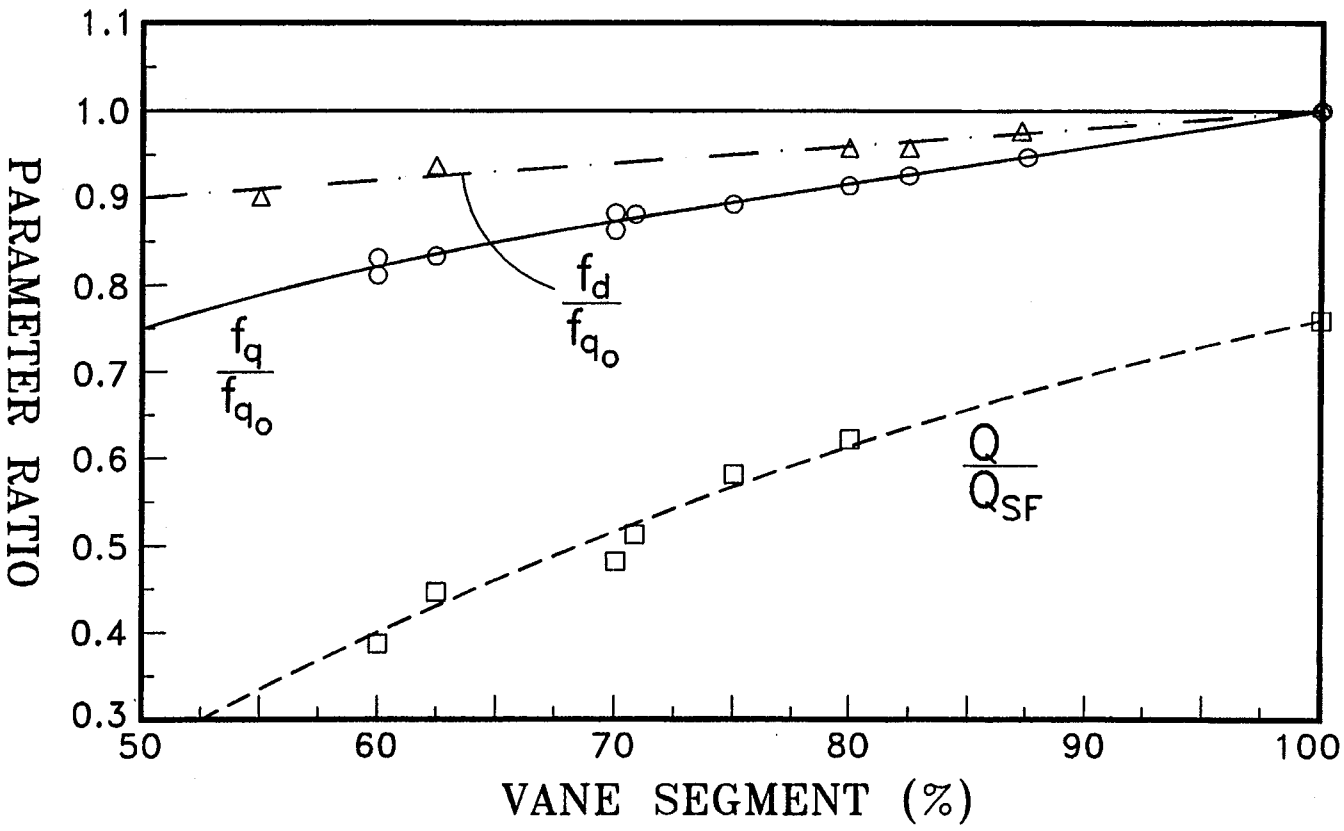
FIG. 7 is a graph of the frequency shift of the dipole and quadrupole modes and the efficiency of operation or quality (Q) factor of the SVRFQ of the present invention relative to a standard 4-vane RFQ as a function of the percentage of vane segment in the SVRFQ.

The shift in frequency of the dipole and quadrupole modes in the SVRFQ as a function of vane segment is shown in FIG. 7. The uppermost curve in FIG. 7 shows the shift in frequency of the dipole modes ($f_d$) relative to the resonant frequency of a 100% RFQ ($f_{q0}$) as a function of vane segment % (VS). As VS decreases, the frequency of the dipole modes decreases. As shown by the next lower curve in FIG. 7, a similar but greater shift in frequency occurs for the frequency of the quadrupole mode ($f_q$). $f_q/f_0$ crosses and drops below $f_d/f_{q0}$ at about 93% vane segment. Thus, in designing the more readily tunable SVRFQ of the present invention, it is recommended that a vane segment of less than 93% be employed. Also, as the vane segment decreases, the separation of the frequency of the dipole and quadrupole modes increases until below about 85% VS, the modes are sufficiently separated to insure that there is no problem of competition between dipole and quadrupole modes leading to longitudinal magnetic field errors.

The lowermost curve in FIG. 7 depicts quality factor Q or efficiency of operation of the SVRFQ relative to a theoretical value of quality factor Q, derived by use of an electromagnetic field computer code SUPERFISH commonly employed in the design of linear accelerators and available from the Los Alamos Accelerator Laboratory, Code Group, Los Alamos, New Mexico. For a 100% vane segment, the quality factor is about 75% of the theoretical value $Q_{sf}$. As windows are included in the SVRFQ and enlarged, the induced rf current path length increases causing higher power losses and a reduction in the quality factor. This is depicted in the lowermost curve by the ratio of $Q/Q_{sf}$ as a function of vane segment percentage. In practice, since a quality factor which is 40% of the theoretical value is about a lower limit for desired RFQ operating efficiency, a vane segment of about 60% represents a practical lower limit for the SVRFQ. Thus, 60% and 85% vane segments are practical lower and upper limits for vane segment in a preferred form of the SVRFQ of the present invention.

So, in designing a SVRFQ, if it is desired that the operating frequency be 100 Mhz and the vane segment be 70%, a designer would first consider the quadrupole frequency shift curve $f_q/f_{q0}$ of FIG. 7 for 70% VS. At that point, the ratio of quadrupole mode frequency to 100% RFQ quadrupole frequency is about 87%. Under such conditions, to provide that the operating frequency of the SVRFQ is 100 MHz, the designer should start with a 100% vane segment design for 115 MHz ($115\times0.87=100$). Then the transverse dimensions of the SVRFQ are obtained through the use of one of several available electromagnetic-field computer codes commonly used to determine the dimensions of traditional RFQ devices such as SUPERFISH. In such determination, however, the corresponding 100% VS RFQ frequency (115 MHz) is substituted for the desired operating frequency (100 MHz) in the input to the computer code.

Next, the beam dynamics of the charged particle beam and the desired modulation (serration) of the vane tips of the SVRFQ are computed using one of the conventional RFQ design codes such as PARMTEQ also available from the Los Alamos Accelerator Laboratory. In using such design code for the SVRFQ, however, the beam dynamics calculation should be based upon the final operating frequency and not the 100% VS frequency.

Thus designed, and as depicted by the frequency shift curves of FIG. 7, the vane windows of the SVRFQ not only result in decrease of the resonant frequency relative to that of a conventional 4-vane RFQ, but also increase the frequency separation between the quadrupole and dipole rf resonant modes and for the symmetrical window configuration invert the order of the lowest frequency modes.

In particular, in any RFQ, the three lowest order resonant modes (the zero-order modes) consist of a quadrupole and two dipole modes. In a 4-vane RFQ, the zero-order dipole modes are lower in frequency than the zero-order quadrupole mode while in a 4-rod RFQ, the quadrupole mode is lowest in frequency. The desired operating mode is always the zero order quadrupole mode that has a uniform rf field intensity along the length of the structure.

Further, in conventional RFQ's, dipole and quadrupole mode competition or mode coupling is primarily responsible for both longitudinal and transverse field errors. The potential for coupling between the desired quadrupole and undesired dipole modes is proportional to the frequency separation of these modes. The greater the separation, the less the potential for coupling. Coupling between longitudinal dipole and quadrupole modes can be a particularly severe problem in "long" RFQ's since the frequency separation between longitudinal modes is inversely proportional to the length of the RFQ. The probability of higher-order dipole modes being near even at the frequency of the lowest-order quadrupole mode becomes high. The precise frequency spectrum of such an RFQ is not easy to predict because the additional capacitance of the vane ends causes the electrical length of the vanes to be different from the physical length by an amount that depends on the details of the vane ends; the resulting three-dimensional problem is quite difficult to solve.

The SVRFQ, on the other hand, minimizes both transverse and longitudinal coupling problems by increasing the frequency separation between the lowest order quadrupole and dipole modes and in the symmetrical window configuration inverting the mode structure so that the quadrupole mode lies at the lowest frequency. In addition, the SVRFQ can be significantly smaller and easier to tune than its 4-vane counterpart and is well-suited for use in the frequency range between 150 and 300 MHz where 4-vane devices are becoming impractically large and where the efficiency of 4-rod devices is decreasing. The increase in "tunability" also allows increasing the operating frequency of the SVRFQ above the present limit of the traditional 4-vane RFQ. Alternatively, the SVRFQ geometry allows packaging an RFQ within dimensions smaller than conventional 4-vane geometry would normally allow.

Figure 8:
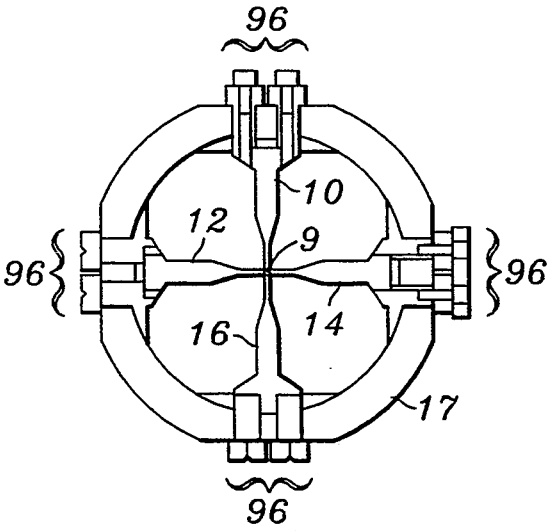
FIG. 8 is an end view showing of the attachment of the vanes to the housing for the SVRFQ.

Referring to FIG. 8, the housing 17, in the form of a pipe or tube, is the main structural element of the SVRFQ and serves as the means for defining a radio-frequency resonator cavity with a centerline axis 9. The tube and the four vanes 10, 12, 14 , and 16 are made from aluminum. The vanes are mounted inside the tube on similar conventional push/pull screw assemblies 96. The assemblies 96 hold the vanes in position and provide for their precise alignment using conventional means such as micrometer threads, precision alignment surfaces, and a locking plate. The majority of the external surfaces are copper plated for electrical conductivity.

The vacuum requirement for the SVRFQ is enormously simplified by surrounding the entire SVRFQ assembly with a simple vacuum manifold, thereby eliminating hundreds of vacuum seals that would otherwise be required.

Thus, the SVRFQ design advantageously provides low fabrication costs, lightweight structure, easy assembly and disassembly, removable vanes design flexibility, rigidity, superb alignment capabilities, and excellent vacuum properties.

The cross section of a preferred SVRFQ cavity is shown in FIG. 8. Preferably, the SVRFQ resonates at 212.5 MHz, and has an inside diameter of 26 cm, an aperture diameter of 5 mm, and constant vane-tip radius of 2.0 mm. The peak rf power is 70 kW and the output particle current is 20 mA. The mechanical design is based on the use of a heavy-walled aluminum tube (12" outer diameter, 10.24" inner diameter) as the main structural element of the assembly. After all welding on the assembly is completed, the assembly is stress relieved before final machining. The latter includes boring the inside of the cylinder to the precise diameter of 10.24 inches, and matching four precision flats on the outer surface of the cylinder. Extreme care must be taken to insure that these flats are parallel to and equidistant from the axis of the interior surface and parallel or perpendicular to each other. The preferred SVRFQ is 1.02 meters long.

The four SVRFQ vanes are mounted inside the heavy-walled aluminum housing as shown in FIG. 8. Electrical contact between the vanes and the vane housing is based on flexed fins at the base of the vanes, which are designed to produce a force of 100 pounds per square inch or greater against the housing. The range of fin flexure is designed to allow mechanical alignment of the vanes with a tolerable effect on this contact force.

Preferably, the vanes are fabricated from the aluminum alloy 7075, which has the best spring properties for the flexed fins. The vane material is purchased as rectangular bars with gun-drilled cooling channels through their long dimensions. Bars, bolted to a rigid machining fixture, are machined to the desired cross section by conventional CNC milling machines. At this stage, the vane tip is still in the form of a rectangular blade 0.4 cm thick. The ends of the vanes are cut off and contoured by a computer-controlled wire electrical discharge machining (EDM) process. The last step in the machining of the vanes is to put the delicate contours on the vane tips.

The longitudinal vane-tip profile involves a numerical solution of the idealized RFQ potential function. Computer Aided Machining (CAM) processes translate most cutting processes into straight line segments and circular arcs. Using these segments, the standard vane-tip profile between a peak and an adjacent valley is translated into three segments, namely a circular arc, a straight line, and a circular arc, in such a way as to preserve the height and location of the peak, the depth and location of the valley, the slope at the midpoint between the peak and valley, and a smooth interface between all segments. At the input end of the SVRFQ, the radial matching section is blended smoothly into a radial cut forming the end of the vane tip. At the output end of the SVRFQ, a circular arc, of one-centimeter radius, is appended to each vane, blending smoothly with the radial cut forming the end of the vane tip.

The interior surface of the vane housing and the majority of the vane surfaces are copper plated, in the preferred embodiment, for electrical conductivity.

The SVRFQ assembly process starts with the installation of the micrometer-thread pushing screws of the assemblies that form the alignment surfaces and locking plates that restrict their motion. The pushing screws are initially set to their nominal position relative to the flats on the exterior surface of the vane housing. The vanes 10, 12, 14, and 16 are installed in their nominal positions, one at a time, in any order. They may be aligned as they are installed or the alignment may be postponed until several or all have been installed. After the vanes are installed, the position of the vanes is adjusted by moving the pushing and pulling screws to achieve the desired gap spacing. The counteracting forces from the pushing and pulling screws keeps the vane position under positive control and contributes to the alignment accuracy achievable from this design.

Advantageously, all of the measurements required to align a vane, or to check its alignment, can be made at any time without regard to the status of the other vanes. The primary reference for all alignment measurements are the four flat surfaces accurately machined on the outer surface of the housing 17. The vane alignment is based on depth-micrometer measurements from these flats though holes in the housing and the vanes, to selected flat portions of the vanes.

The symmetric, antisymmetric, and asymmetric variations of the segmented-vane RFQ represent the three possible combinations of vane windows. In the symmetric configuration shown in FIGS. 9 and 9A, each of the four vanes has windows and vane segments in identical longitudinal positions. In principle, this arrangement makes the frequencies of the two dipole modes degenerate. In actuality, small mechanical misalignments separate the frequencies of the two modes. The frequency separation between the dipole modes may be used as a qualitative measure of the mechanical alignment.

In the antisymmetric configuration as shown in FIGS. 10 and 10A, the degeneracy of the dipole modes may or may not be destroyed depending on the distribution of the windows. One of the dipole modes will be more sensitive to perturbation in one pair of the four quadrants while the other dipole mode will be sensitive to perturbations in the other pair of quadrants. This feature can be used to help diagnose which adjustments to make during the tuning process.

The asymmetric configuration as shown in FIGS. 11 and 11A, due to its inherent asymmetry, is more amenable to the installation of external field stabilization devices. There is no inherent symmetry of the windows to be disturbed by placement of the external devices.

While a preferred SVRFQ has been set forth above, the present invention is not limited by the embodiment described herein. Many obvious variations and modifications can be made and are intended to be within the scope of the present invention as defined by the appended claims.

We claim:

1. A segmented vane radio-frequency quadrupole accelerator, comprising:

means for defining a radio-frequency resonator cavity elongated along a centerline axis;

four axially elongated vanes each having opposite ends, an elongated base and a tip opposite the base, the base of each vane being secured to an inner wall of the cavity such that the vanes are circumferentially evenly spaced and extend inwardly from the inner wall towards the centerline axis to define first and second pairs of opposing vanes having tips facing each other and transversely dividing the cavity into four equal axially extending quadrants;

means for generating longitudinally extending alternating magnetic fields along the quadrants to wrap around the ends of the vanes into adjacent quadrants to induce alternating surface currents in each quadrant circulating circumferentially along the inner wall of the cavity and radially extending surfaces of the vanes bounding each adjacent quadrant so that the tips of the first and second pairs of vanes cyclically assume an opposite potential, whereby a quadrupole electric field is established in a region surrounding the pairs of vanes, the quadrupole electric field serving to accelerate charged particles axially through the cavity and to focus the charged particles toward the axis of the cavity; and one or more of the four vanes including one or more windows in the form of apertures therethrough at locations spaced from the ends of the vanes whereby the magnetic fields pass through the windows into adjacent quadrants intermediate as well as at the ends of the vanes and the surface currents in circulating in the quadrants bend longitudinally around the windows to lengthen in path length.

2. The apparatus of claim 1 wherein all four of the vanes have substantially identical windows at substantially identical locations.

3. The apparatus of claim 1 wherein the first pair of vanes have windows at substantially the same locations the second pair of vanes are solid.

4. The apparatus of claim 1 wherein one of the vanes has one or more windows at substantially the same locations where the remaining three vanes are solid.

* * * * *